US006579195B2

(12) United States Patent
Lamb

(10) Patent No.: US 6,579,195 B2
(45) Date of Patent: Jun. 17, 2003

(54) BASEBALL SWING TRAINER DEVICE

(76) Inventor: Juston Floyd Lamb, 26311 295th St., Ollie, IA (US) 52576

( * ) Notice: Subject to any disclaimer, the term of this patent is extended or adjusted under 35 U.S.C. 154(b) by 0 days.

(21) Appl. No.: 09/867,946

(22) Filed: May 30, 2001

(65) Prior Publication Data

US 2002/0183140 A1 Dec. 5, 2002

(51) Int. Cl.[7] ..... A63B 69/40
(52) U.S. Cl. ..... 473/417; 473/490; 473/499
(58) Field of Search ..... 473/417, 419, 473/420, 421, 422, 452, 453, 468, 469, 470, 490, 499

(56) References Cited

U.S. PATENT DOCUMENTS 4,659,084 A * 4/1987 Vuick
4,886,267 A 12/1989 Licciardi et al.
5,029,852 A * 7/1991 Gilfillan
5,087,039 A * 2/1992 Laseke
5,106,085 A * 4/1992 Lewy
5,351,948 A * 10/1994 Thomas
5,370,385 A 12/1994 Joy
5,435,545 A 7/1995 Marotta
5,452,896 A 9/1995 Core
5,516,115 A 5/1996 McLain
5,553,847 A * 9/1996 Surrency
5,595,384 A 1/1997 Hardison, Jr.
5,607,150 A * 3/1997 Schnorr, III
5,634,858 A * 6/1997 Bellagamba
5,642,880 A 7/1997 Wiseman et al.
5,830,079 A * 11/1998 Hudson
5,916,045 A * 6/1999 Busch
5,951,413 A 9/1999 Guerriero
6,306,050 B1 * 10/2001 Holder
6,312,349 B1 * 11/2001 Roberts

* cited by examiner

*Primary Examiner*—Paul T. Sewell
*Assistant Examiner*—Nini F. Legesse
(74) *Attorney, Agent, or Firm*—McKee, Voorhees & Sease, P.L.C.

(57) ABSTRACT

The unitary structure includes a rear frame member from which oppositely disposed side frame members extend forwardly. Laterally extending forward frame members are provided on the side frame members to define batting boxes for left and right hand batters. A pair of upstanding spaced apart posts are mounted on the rear frame member and include a center line extending forwardly through the strike zone. The guidepost adjacent the batter helps to define a swing path.

11 Claims, 5 Drawing Sheets

BASEBALL SWING TRAINER DEVICE

BACKGROUND OF THE INVENTION

Young persons learning recommended batting techniques need to be aware of possible problems that can cause poor performance. Three of the typical problems faced by the batter are the tendency to: (1) overstride, (2) step in the bucket, and (3) drag the bat through the strike zone. A baseball swing training device is needed that will make the batter aware of these problems if they occur and enable the person to correct them through use of the training device.

BRIEF SUMMARY OF THE INVENTION

The baseball swing trainer of this invention includes a frame having forward and rearward frame members interconnected by a side frame member defining a batters box. A pair of spaced apart upstanding guideposts are slidably mounted on the rear frame member with a forwardly extending center line there between passing through the center of the strike zone and thereby providing a target for pitchers delivering balls to a batter. Alternatively, a ball may be placed on a batting tee positioned on the center line.

The upstanding post on either side of the strike zone center line allows for either right or left hand batters to use the training device and the guidepost on the batters side will serve to limit the bat travel in addressing the ball thereby insuring that the batter uses the proper swing technique.

The guideposts of the training device are behind the batter and on opposite sides of the center line of the strike zone thus out of the way of a thrown ball thereby minimizing the risk of ricochet balls hitting the batter from the backside.

An improper batting technique involves the batter taking the bat straight back and thus with use of the training device of this invention, the bat will hit the adjacent guidepost reminding the batter that the bat must follow a more vertical projectory forward of the guidepost.

The training device is made of one and a half inch furniture grade PVC. The forward frame members are adjustably connected to the side frame members through slip joints including sleeves that receive the side frame members. The same is true with the vertical guide members having sleeves which receive the rear frame member for allowing the vertical guideposts to be spaced apart as desired to provide a strike zone of the desired width.

DETAILED DESCRIPTION OF THE PREFERRED EMBODIMENT

Figure 1:
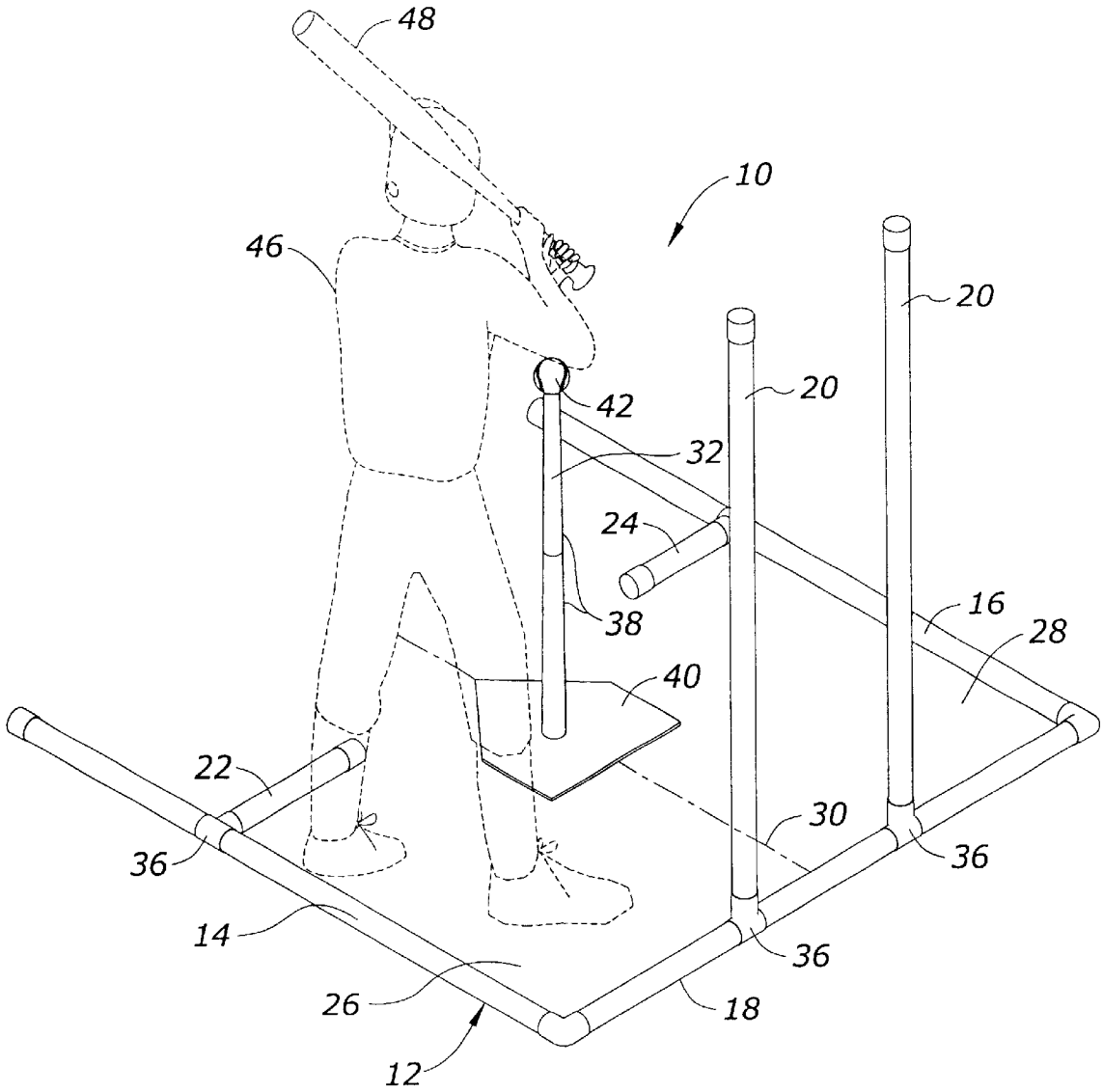
FIG. 1 is a rear perspective view of the baseball trainer swing frame of this invention in use with a batting tee.
Figure 2:
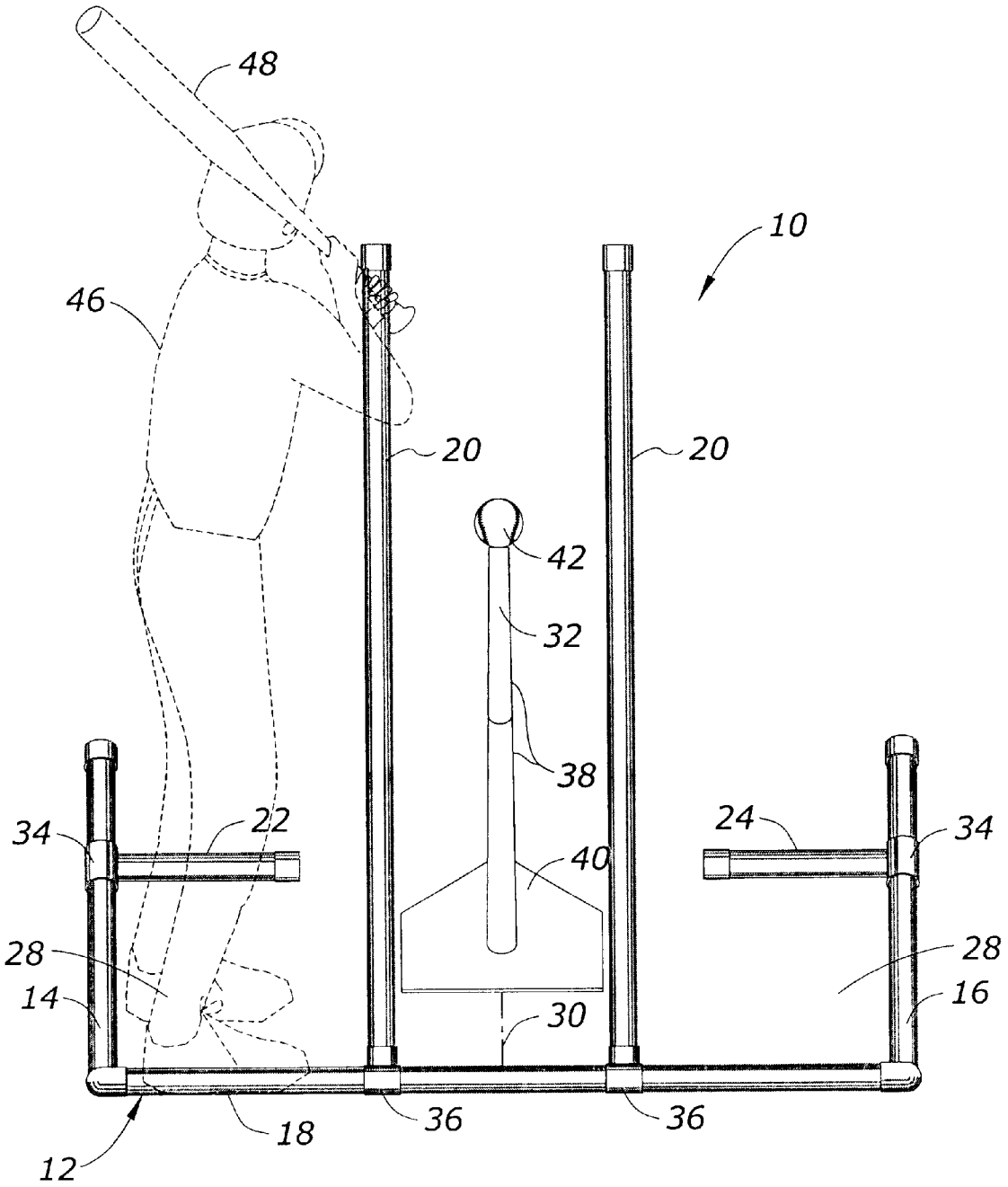
FIG. 2 is a rear elevational view thereof.
Figure 3:
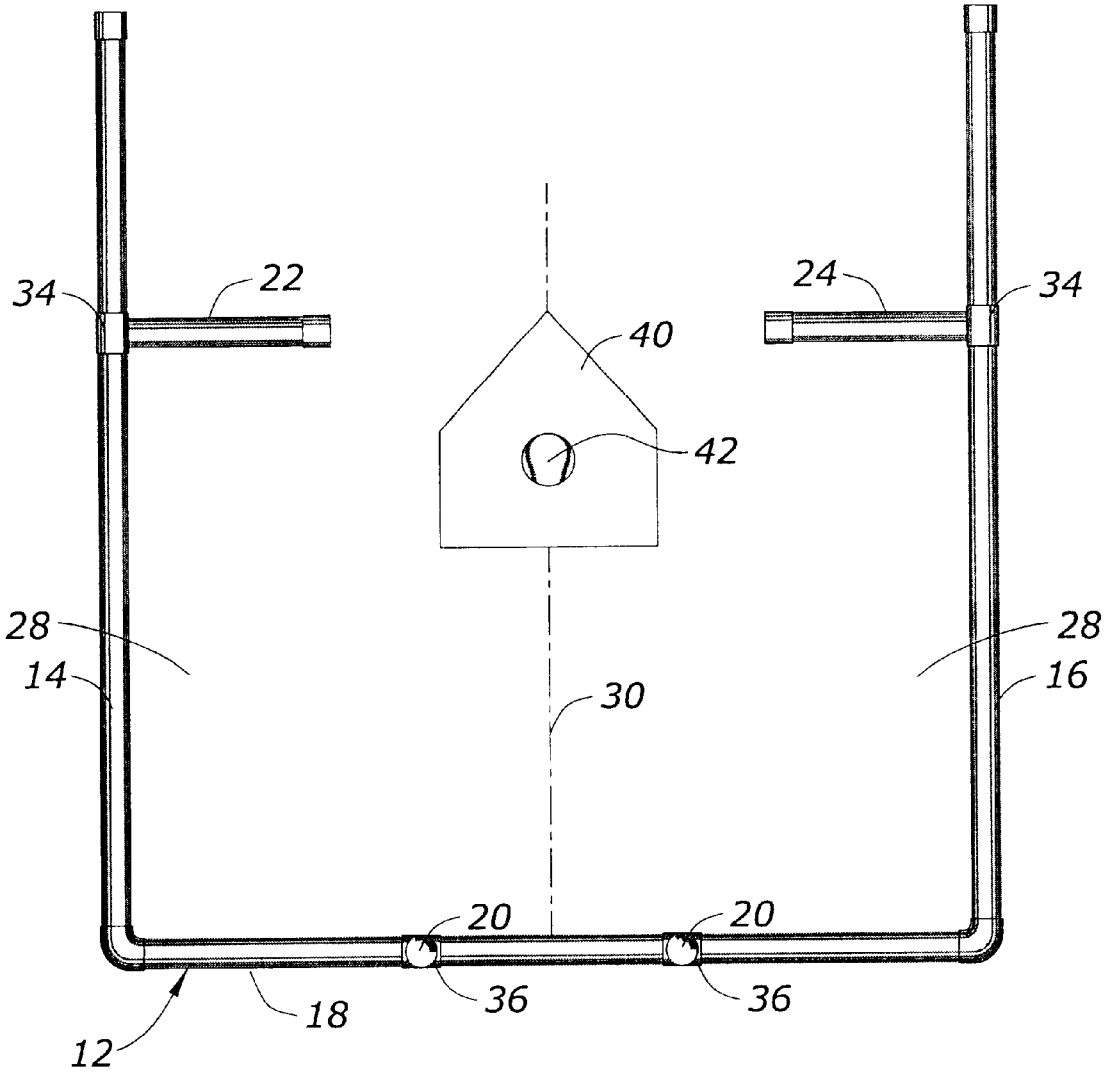
FIG. 3 is the top plan view thereof.

The baseball swing trainer device of this invention is referred to generally in FIG. 1 by the reference numeral 10 and includes a frame structure 12 having oppositely disposed side frame members 14 and 16 interconnected by a rear frame member 18 having a pair of spaced apart upstanding guide members 20 mounted thereon.

Forward laterally inwardly extending frame members 22 and 24 extending from the side frame members 14 and 16 respectively help to define right and left hand batters boxes 26 and 28 respectively. It is seen that the upstanding guideposts 20 are on opposite sides of a center line 30 extending forwardly through the batter's strike zone and in the plane of a batting tee 32.

The forward frame members include slip T end pieces 34 which involve sleeves receiving the side frame members 14 and 16 to allow for adjustable positioning of the forward frame members 22 and 24 to vary the length of the batters boxes 26 and 28. Similarly, the guideposts 20 include slip T joints 36 allowing slidable positioning of the guidepost 20 on the rear frame number 18 to vary the width of the strike zone.

The batting tee 32 includes a pair of telescopic sections 38 and a home plate shaped base 40 with a ball 42 positioned on the upper end of the tee.

It is seen that in use a batter 46 having a bat 48 will be made aware of the limits defining the batters box by the frame members 14, 18 and 22 for the right hand batters box 26. The adjacent guidepost 20 will cause the batter's swing projectory for the bat 48 to be downwardly and forwardly rather than following a swing path that is too horizontal.

Figure 4:
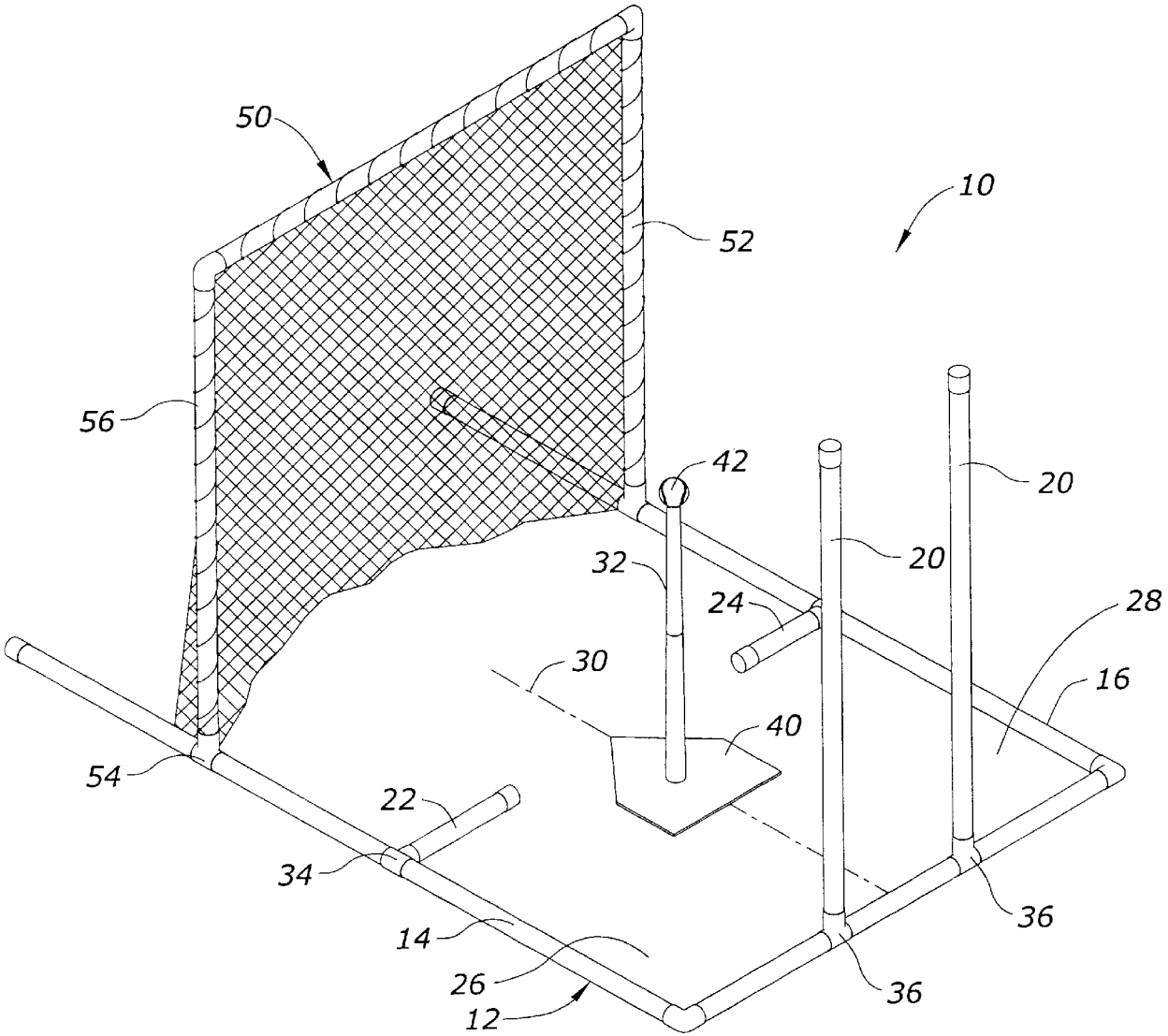
FIG. 4 is a perspective view of an alternate embodiment including a screen positioned forwardly of the batting tee.

As seen in FIG. 4 a screen 50 may be mounted forwardly of the batting tee 32 and includes a plastic tubing frame 52 having slip joint T's 54 on the lower ends of side frame members 56 for slidably receiving the opposite side frame members 14 and 16.

Figure 5:
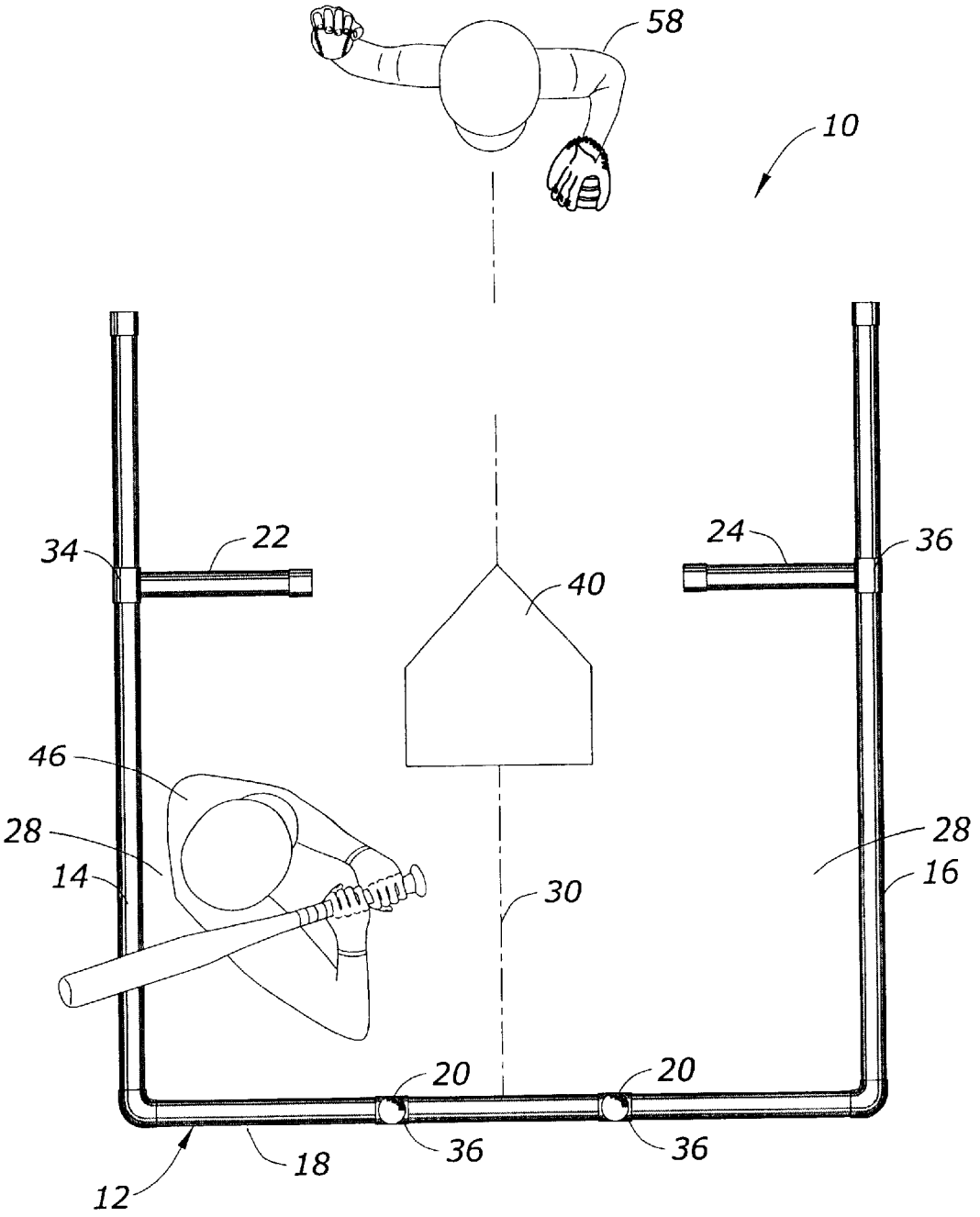
FIG. 5 is a top plan view of the training device being used with a pitcher throwing pitches to a batter.

In FIG. 5 a pitcher 58 is shown throwing balls to the batter 46 over the center line 30 extending between the upstanding guideposts 20 which define the width of the strike zone. Since the guideposts 20 are rearwardly of the batter 46 and on the outer limits of the strike zone the chance of the ball ricocheting into the batter is reduced.

What is claimed is:

1. A baseball swing trainer device comprising, a frame having forward and rearward laterally extending frame members interconnected by an outer side frame member defining three sides of a batters box, and a pair of laterally spaced apart upstanding guideposts on said rearward frame member defining a center line therebetween extending forwardly through the strike zone of the swing training device parallel to said outer side frame member and defining a fourth side of said batters box.

2. The baseball swing trainer device of claim 1 and a batting tee is positioned on the center line.

3. The baseball swing trainer device of claim 1 wherein a second batters box is defined by said rearward member extending laterally away from said first outer side frame member into engagement with a second forwardly extending outer side frame member in turn engaging a laterally inwardly extending second forward frame member.

4. The baseball swing trainer device of claim 3 wherein said first and second laterally extending forward frame members are in alignment with each other.

5. The baseball swing trainer device of claim 3 and each of said first and second outer side frame members include forwardly extending portions.

6. The baseball swing trainer device of claim 5 and a laterally extending upstanding screen and frame are connected to said forwardly extending side frame portions in spaced relation to said first and second laterally extending forward frame members.

7. The baseball swing trainer device of claim 6 wherein said first and second forward laterally extending frame members include inner ends in spaced apart relation to each other to define space for a batters tee.

8. The baseball swing trainer device of claim 3 wherein said pair of spaced apart upstanding guideposts include lower ends slidably connected to said rearward frame member for selectively varying the width of the strike zone.

9. The baseball swing trainer device of claim 8 wherein said slidable connection includes a slip T joint on the lower end of each of said guideposts wherein a sleeve slidably receives said rearward frame member.

10. The baseball swing trainer device of claim 1 wherein said laterally extending forward frame member is forwardly and rearwardly adjustably connected to said side frame member to selectively vary the size of the batters box.

11. The baseball swing trainer device of claim 10 wherein said connection between said forward laterally extending frame member and said side frame member is through a slip T joint wherein a sleeve is provided on the outer end of said forward frame member and said side frame member is slidably received therein for slidable adjustment as required.

* * * * *